United States Patent [19]

Torres

[11] 4,239,235

[45] Dec. 16, 1980

[54] TRAINING DEVICE FOR FOOTBALL OR FOR ALL GAMES USING A SMALL OR LARGE BALL

[76] Inventor: Remy G. Torres, 1 rue de la Scie, Seyssinet Pariset, Isere, France

[21] Appl. No.: 867,476

[22] Filed: Jan. 6, 1978

[30] Foreign Application Priority Data

Jan. 6, 1977 [FR] France ..... 77 00943
Nov. 10, 1977 [FR] France ..... 77 345281

[51] Int. Cl.[3] ..... A63B 67/00

[52] U.S. Cl. ..... 273/395; 273/411; 273/29 A

[58] Field of Search ..... 273/26 A, 411, 29 R, 273/29 BD, 29 A, 29 B, 29 BA, 29 BB, 29 BE, 29 BF, 29 BG, 181 R, 181 F, 181 K, 55 B, 102 R, 102 S, 127 R, 127 C, 30, 395, 95 H, 1 B, 85 R, 1 R, 96; 124/41 C, 56; D25/78, 38, 39; 46/61

[56] References Cited

U.S. PATENT DOCUMENTS

| | | | |
|---|---|---|---|
| 1,322,754 | 11/1919 | Blair | 273/29 B |
| 1,959,574 | 5/1934 | Dunscombe | 273/29 B |
| 2,161,463 | 6/1939 | Frost | 273/30 |
| 2,162,438 | 6/1939 | Letaret | 273/26 A |
| 2,408,071 | 10/1968 | Lundy | 273/26 A |
| 2,497,925 | 2/1960 | Bergerioux | 273/30 |
| 2,944,816 | 7/1960 | Dixon | 273/26 A |
| 2,992,002 | 7/1961 | Binghan, Jr. | 273/26 A |
| 3,195,898 | 7/1965 | Respini | 273/181 F |
| 3,427,026 | 2/1969 | Mahoney | 273/29 R |
| 4,116,446 | 9/1978 | Thompson | 273/181 F |

FOREIGN PATENT DOCUMENTS

| | | | |
|---|---|---|---|
| 4982 | of 1902 | United Kingdom | 273/30 |
| 191330 | 1/1923 | United Kingdom | 273/29 BD |

*Primary Examiner*—Richard C. Pinkham
*Assistant Examiner*—T. Brown
*Attorney, Agent, or Firm*—Remy J. VanOphem

[57] ABSTRACT

A training device for football or other ball games comprises an inextensible net stretched between two opposed side edges integral with rectilinear and semi-rigid members. These members are connected to the uprights of a frame by elastic tensioning members attached to hooks of the frame. The upper and lower longitudinal edges are integral with elastic tensioning members extending from one member to the other. The device facilitates training without having to run after the ball.

7 Claims, 41 Drawing Figures

TRAINING DEVICE FOR FOOTBALL OR FOR ALL GAMES USING A SMALL OR LARGE BALL

BACKGROUND OF THE INVENTION

The present invention relates to a training device for football or for all games using a small or large ball.

SUMMARY OF THE INVENTION

This training device enables the sportsman to work seriously without wasting time and tiring himself to no avail by running after the ball.

This training device also makes it possible to find pleasure in practicing sport at an age where it is too tiring to run after a ball.

Furthermore, in the particular case of tennis, this training device advantageously replaces the traditional wall for training alone.

A training device according to the invention is characterized in that it comprises an inextensible net stretched by means of two substantially parallel upright members integral with its two edges at opposite ends.

According to an additional feature of the invention, each upright is semi-rigid and is connected to a frame or fixed posts by means of resilient members ensuring the tension of the net.

According to an additional feature of the invention, the upright members are constituted by rectilinear and vertical bars.

According to one variation of the invention, each upright member comprises at least two parts provided with connecting means in order to be connected end-to-end or disconnected.

According to another variation of the invention, the two substantially horizontal edges of the net are integral with resilient tensioning members each extending from one upright member to the other.

According to an additional feature of the invention, at least one of the two terminal upright members is provided with a series of removable straps, each strap comprising two ends able to be fixed to the corresponding upright member and a middle part able to pass through one mesh of the net while retaining a certain length of net against the bar, which makes it possible to adjust the length of the latter.

According to an additional feature of the invention, at least one casing for the edge of the net is provided, comprising a band whereof the two free edges are provided with clips in order to be fixed one on the other in a removable manner on either side of the net, whereby a greater or lesser width remains trapped inside the casing.

According to an additional feature of the invention, the net is mounted inside a frame whose upper cross bar is provided with a series of hooks to which the upper edge of the net is attached.

According to one variation of the invention, each member comprises at least two independent parts placed end-to-end and each able to be attached to a stationary upright, the two semi-rigid members having corresponding parts such that, depending on the shape of the uprights used, it is possible to stretch the net in order to obtain at least two non-parallel planes, each plane being defined between two parts of the semi-rigid member.

According to another variation of the invention, the two semi-rigid members are constituted by two concave bars respectively connected to the upper and lower edges of the net and attached inside a frame of appropriate shape.

According to another variation of the invention, the training device also comprises two rigid stiffeners, namely one at each end, as well as resilient connecting members extending between the uprights and the stiffeners, each upright member being simply engaged through a row of meshes of the net in order to be integral with the net.

According to an additional feature of the invention, each end of the net is integral with three uprights placed end-to-end, but without any connection between the latter, whereas each stiffener comprises three portions each corresponding to one upright and is fixed in a removable manner to a fixed support structure by a transverse securing pivot.

According to an additional feature of the invention, the adjacent end of portions of stiffener are pivoted one on the other and are connected to each other by means of a locking spacer member whereby the points of attachment to the portions of stiffener are located at a distance from the pivot point, at adjustable locations.

According to an additional feature of the invention, the spacer members are secured to the portions of stiffener by means of bolts engaged in holes provided on the spacer members and on the portions of stiffener, the holes in the spacer member being extended in the longitudinal direction, such that it is possible to slide the bolts in the latter before locking them, in order to adjust the relative angular position of the portions of stiffener.

According to one variation of the invention, adjacent ends of the portions of stiffener are pivoted to each other by means of a pivot bolt which passes therethrough successively in transverse direction, each of these pivot bolts being associated with a locking bolt which passes in succession through the two same portions of stiffener in recesses in the shape of a portion of a circle centered about the axis of the corresponding pivot bolt, the locking bolt being able to move along the recesses in the shape of a portion of a circle in order to facilitate relative angular adjustment of the portions of stiffener.

According to an additional feature of the invention, each stiffener comprises, over its entire length, adjacent the net, a series of hooks intended for securing the resilient connecting members to the corresponding uprights.

According to a variation of the invention, each stiffener comprises, over its entire length, a series of C-shaped recesses, through its outer wall, intended for securing resilient connecting cords to the corresponding uprights, each portion of resilient cord overlapping the solid area defined between the two ends of the corresponding C-shaped recess.

According to an additional feature of the invention, each upright is constituted by at least one portion of tube comprising, adjacent the stiffener, a series of holes in which a resilient cord passes, the resilient cord thus extending from one end to the other of the portion of tube, passing in succession inside and outside the portion of tube in the gaps comprised between the holes.

According to an additional feature of the invention, each upright is telescopic and comprises at least two portions of tube fitted one in the other, the series of holes of these portions of tube being arranged such that said resilient cord passes simultaneously through the two portions of tube in the area where the latter overlap, the resilient cord at the same time ensuring locking of the two portions of tube one with respect to the other.

According to an additional feature of the invention, the two ends of said resilient cord are provided with stop means such as a knot and are located inside the corresponding portion of tube, this cord being sufficiently long so that it is possible to stretch its parts located outside the portion of tube and attach each part stretched in this way to a hook of the corresponding stiffener.

According to a variation of the invention, each upright is constituted by a solid bar comprising over its entire length, a series of parallel transverse holes extending from one side to the other and through which a resilient cord passes, the resilient cord extending from one end of the solid bar to the other, passing in succession from one side of the bar to the other in the gaps comprised between the holes.

According to an additional feature of the invention, the arrangement is provided so that it is possible to simultaneously re-tension all the parts of each resilient cord by pulling on one of the ends of said cord, the previously stretched parts thus being placed against the outer surface of the upright, which makes it possible to introduce the upright easily into a series of meshes of the net, the location of this series of meshes being selected, in the net, taking into account the width of the fixed structure to which the stiffeners are fixed.

According to an additional feature of the invention, at each end of the net, each inextensible cord integral with a substantially horizontal edge of the net passes through a hole provided in one end of the corresponding upright, in order to terminate in stop means such as a knot which is too large to be able to pass through said hole, said upright also comprising, at a distance from the hole through which the inextensible cord passes, at least one longitudinal slot provided, opposite the hole, with one enlarged end through which it is possible to pass the knot in the inextensible cord, the remainder of the slot being sufficiently wide to allow the cord to pass, but not the knot, such that it is possible to adjust the useful length of each inextensible cord by threading its ends in appropriate slots.

According to an additional feature of the invention, a rigid member is provided in association with at least one of the uprights, which rigid member is able to be introduced into a row of meshes of the net and to be fixed to said upright by an inextensible strap and which also traps between the upright and the corresponding rigid member, the portion of net located therein and which is more or less slack.

According to one variation of the invention, each stiffener is fixed to the group by its base, by means of a transverse pivot substantially parallel to the net, the upper part of each stiffener also being retained by means of guys anchored at fixed points.

BRIEF DESCRIPTION OF THE DRAWINGS

The accompanying drawings, given as nonlimiting examples, will make it easier to understand the features of the invention.

DESCRIPTION OF THE PREFERRED EMBODIMENT

Figure 1:
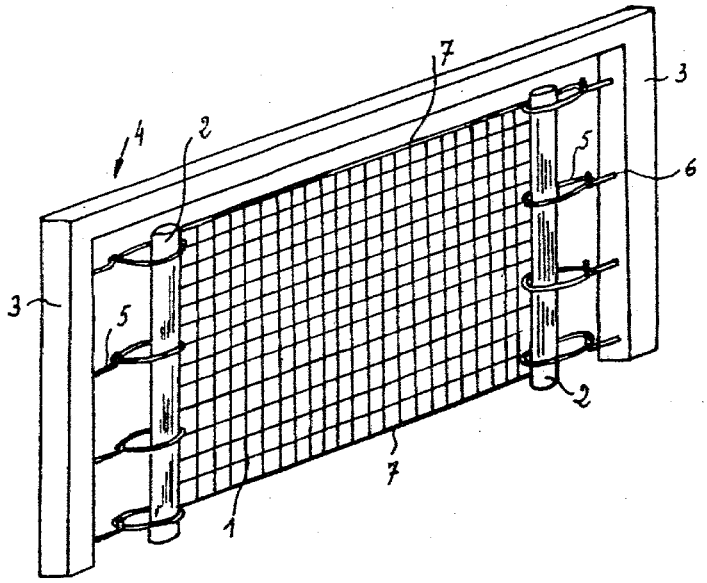
FIG. 1 is a perspective view showing a training device according to the invention, stretched inside a frame.

FIG. 1 shows a training device according to the invention. This device comprises an inextensible net 1 stretched between its two opposed side edges. Each side edge of the net is integral with a rectilinear and semi-rigid member 2. The members 2 may be bars, tubes or simply a large hem. The bars may also be made of wood, metal or even plastic material.

The members 2 are attached to the two uprights 3 of a frame 4 by means of resilient ties 5. The net 1 may comprise eyelets for the passage of the resilient ties 5, but the latter may each pass quite simply through one mesh of the net. Each tie 5 may on the other hand be passed around the corresponding upright 3 or may preferably be attached to one of the hooks 6 integral with the frame 4. The shape of the net 1 is that of an elongated rectangle and its upper and lower longitudinal edges may also be integral with resilient tensioning members 7 each extending from one member 2 to the other.

Whether or not the upper edge of the net 1 is provided with a tensioning member, it is possible to suspend the latter from hooks on the frame. The purpose of this suspension is not to ensure the tension of the net, but simply to prevent the latter from sagging under its weight.

The tension of the net is ensured by means of semi-rigid members 2 and elastic ties 5 supported on the frame 4.

The frame 4 may be the existing goal mouth on a football ground.

The purpose of the training device according to the invention is to return a large or small ball directed towards the latter. It may be used simultaneously by several players wishing to kick a ball with the foot and it advantageously replaces a conventional training wall, since a trainer can be located behind the net and observe the players, which is the ideal situation for correcting defective movements or postures.

The training device facilitates a serious work-out by the sportsman, the latter being able to train for example by kicking the ball into the goal when he is at a distance from the net. He does not need to fetch the ball on each occasion, since the latter returns and he does not tire himself to no avail, which enables him to repeat the exercise many times in succession. In particular, he is able to kick the ball with the left foot, if he is a right-footed player.

The training device according to the invention also makes it possible to push back the age limit for ball games, the fact that the ball returns by itself when kicked making it possible to find pleasure in practicing sport at an age where running is too tiring.

According to variations, the tensioning members constituted by the ties 5 may be made with springs or rubber extensible springs, whereas the bars constituting the members 2 may be telescopic or made in several parts pivoted to each other or which are assembled end-to-end by fitting one in the other or screwing, which makes it possible to fold the net and transport the latter in the boot of a motor vehicle.

It is also possible to fold the net 1 back partly by its sides or by the ends, in order to adapt the latter instantaneously to goal-mouths, cages or posts having varying spacings. In this case, each folded-back edge is trapped inside ties 5 passing through the meshes of the net.

Figure 2:
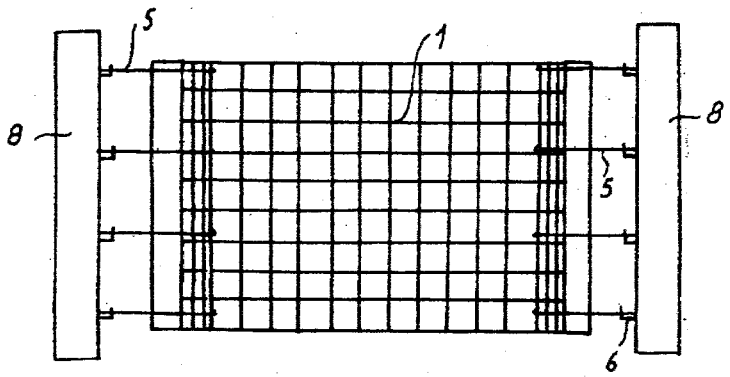
FIG. 2 is a front view showing a training device according to a variation of the invention, stretched between two posts.

By way of example, FIG. 2 shows the training device of FIG. 1 installed between two vertical posts 8. These posts are buried in the ground and they are sufficient for keeping the net taut. It will be seen that it is possible to install a series of pairs of posts, for example around the edge of a football ground, without too great an expense, in order to enable a number of players to train simultaneously.

Figure 3:
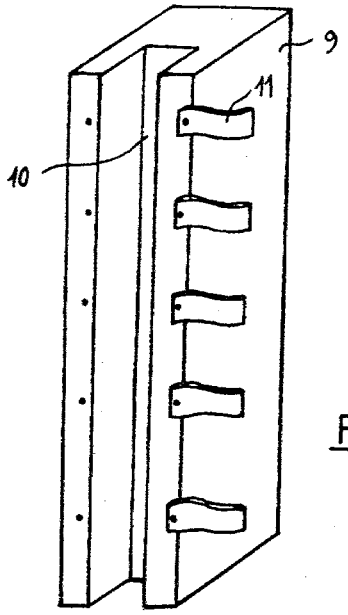
FIG. 3 is a perspective view showing one upright for the net according to another variation of the invention.
Figure 4:
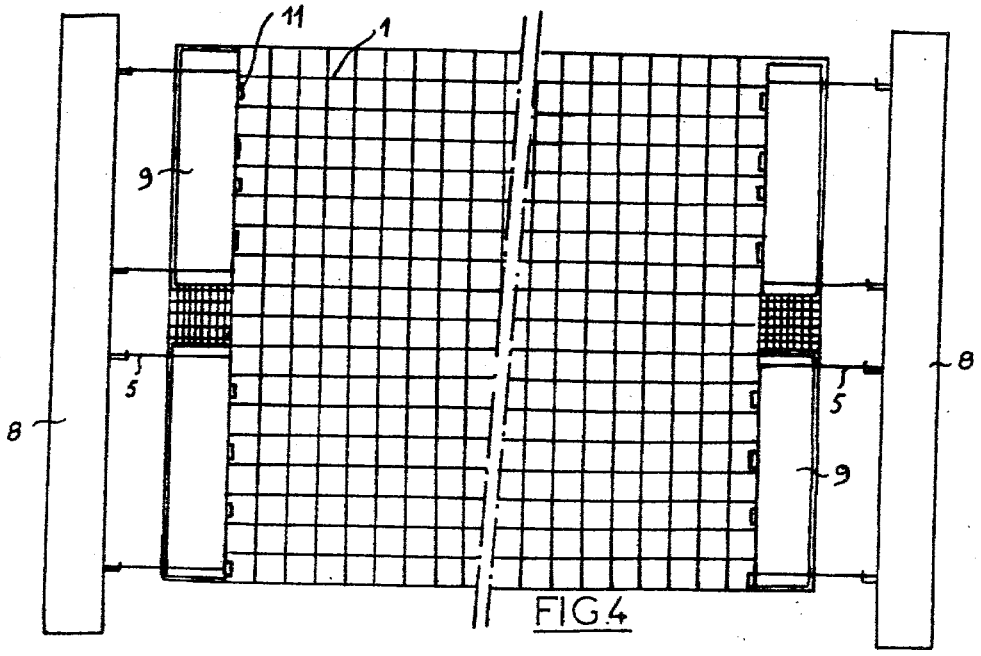
FIG. 4 is a front view of a training device comprising uprights similar to that of FIG. 3.

According to a variation illustrated in FIGS. 3 and 4, each semi-rigid member is constituted by a portion of tube 9 comprising a longitudinal opening 10 and a series of removable straps 11. Each strap may be fixed by its respective ends on either side of the opening 10, whereas its middle part is engaged in one of the meshes of the net 1. The length of the net is adjusted by trapping part of the net inside each portion of tube 9, which is also in two parts, to facilitate transportation. Resilient ties 5 still ensure the tension of the net by connecting the portions of tube 9 to the vertical posts 8.

Figure 6:
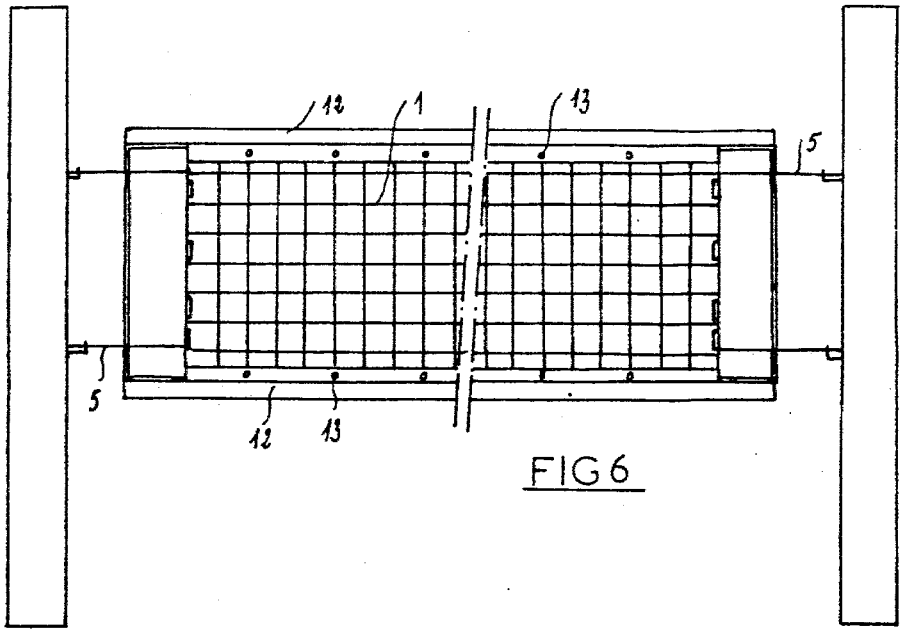
FIG. 6 is a front view of a training device comprising casings for the edge of the net similar to that of FIG. 5.
Figure 5:
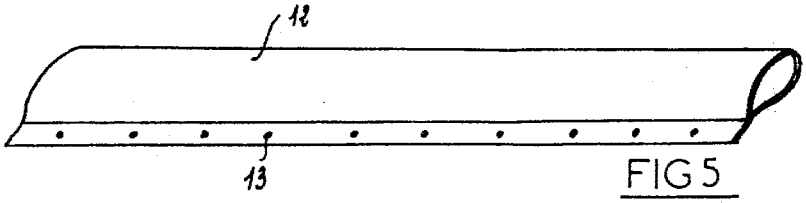
FIG. 5 is a perspective view showing a casing for an edge of the net.

According to another variation illustrated in FIGS. 5 and 6, the device may also comprise one or two casings for the edge of the net, inside which one traps the longitudinal edges of the net, when it is desired to reduce the height of the net. Each casing 12 is made in the form of a band of plastics material, sheet metal or the like whereof the two opposed edges are provided with clips 13 and may thus be connected on either side of the net 1, whereas a greater or lesser width of net remains trapped inside the casing.

The clips 13 may advantageously be press buttons and each end of the casing may be connected to the corresponding post 8 by means of a resilient tensioning member 5.

Figure 7:
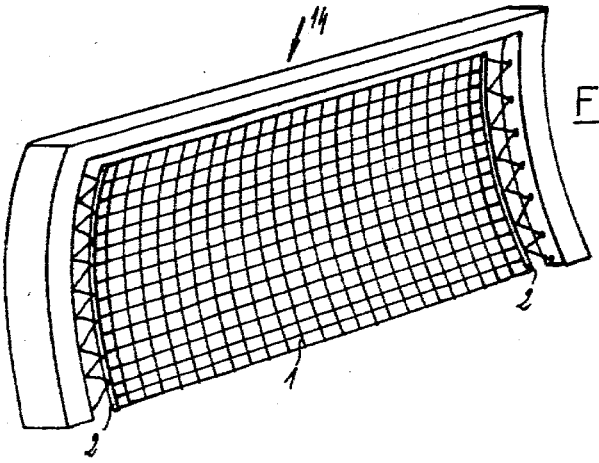
FIG. 7 is a perspective view showing a training device provided with two lateral concave semi-rigid members, according to another variation of the invention.

According to another variation illustrated in FIG. 7, the two semi-rigid members 2 are concave, so that they can each be fixed against one of the concave uprights of a goal-mouth 14. The net 1 is thus also concave and it has the appearance of a cylindrical reflector. A training device of this type is useful for practicing volleying. The ball is hit towards the bottom of the net, the ball bounces upwards and can be returned on the volley.

Figure 8:
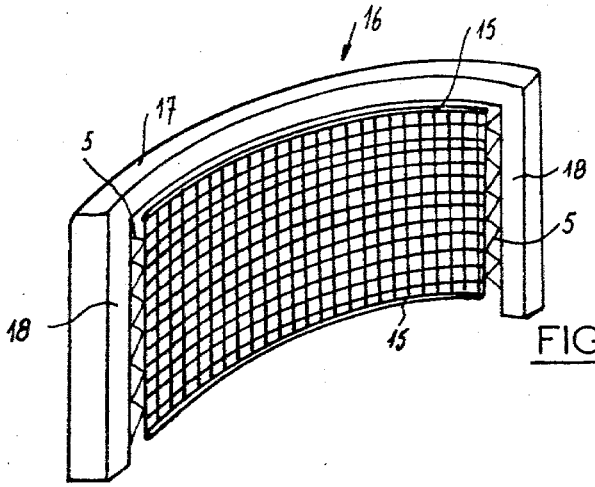
FIG. 8 is a perspective view showing a training device provided with an upper and lower concave semi-rigid member respectively, according to another variation of the invention.

According to another variation illustrated in FIG. 8, there are two longitudinal semi-rigid members 15 which are concave in order to extend inside a goal-mouth 16 whose upper cross bar 17 is concave in the same manner. Each terminal edge of the net is attached to an upright 18 of the goal-mouth 16 by means of ties or tensioning members 5.

Figure 9:
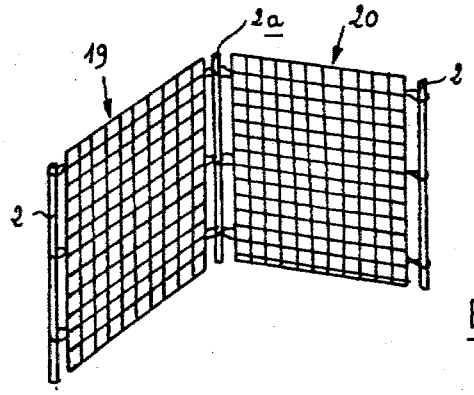
FIG. 9 is a perspective view showing a training device provided with three vertical semi-rigid members according to another variation of the invention.

According to another variation illustrated in FIG. 9, a training device comprises a net in two parts 19 and 20 separated by a transverse semi-rigid rectilinear member 2*a* parallel to the vertical terminal rectilinear members 2. Each member is attached to a post by means of tensioning devices. According to the arrangement of three posts used, the two parts 19 and 20 form a more or less acute angle whose apex line is vertical.

Figure 10:
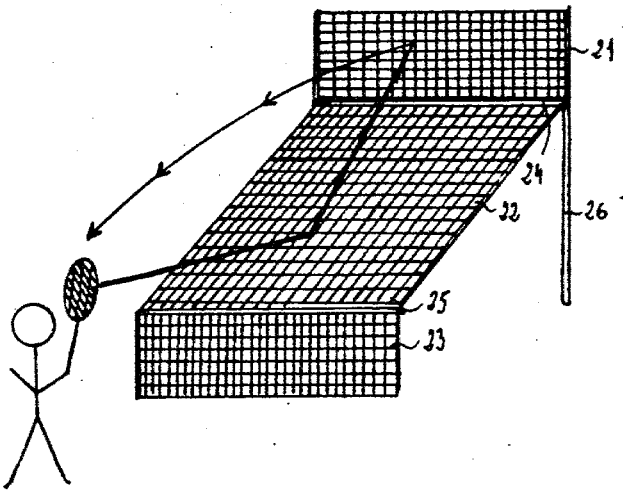
FIG. 10 is a perspective view showing a training device provided with two lateral semi-rigid members in three parts, according to another variation of the invention.

According to another variation illustrated in FIG. 10, each semi-rigid terminal member is formed from several rectilinear sections placed end-to-end without any connecting means. The net is thus divided into three areas 21, 22 and 23 as regards height, each of these areas defining a plane bordered by two sections of member 24, 25 or 26. It is possible to orientate the planes of the areas 21 to 23 as desired by stretching the sections 24, 25 and 26 between the appropriate posts. In the case of FIG. 10, the areas 21 to 23 define a plane inclined downwards in a forwards direction opposite the players on either side of two substantially vertical planes.

This latter variation is particularly suitable for training for tennis, when one has neither a court nor a wall. It is possible to practice serving by hitting the ball downwards in order that the latter bounces successively on the inclined plane and on the upper vertical plane and can be returned on the volley.

It will be noted that this inexpensive training device may be installed in a school courtyard in order to teach pupils to play tennis where no court is available.

Figure 11:
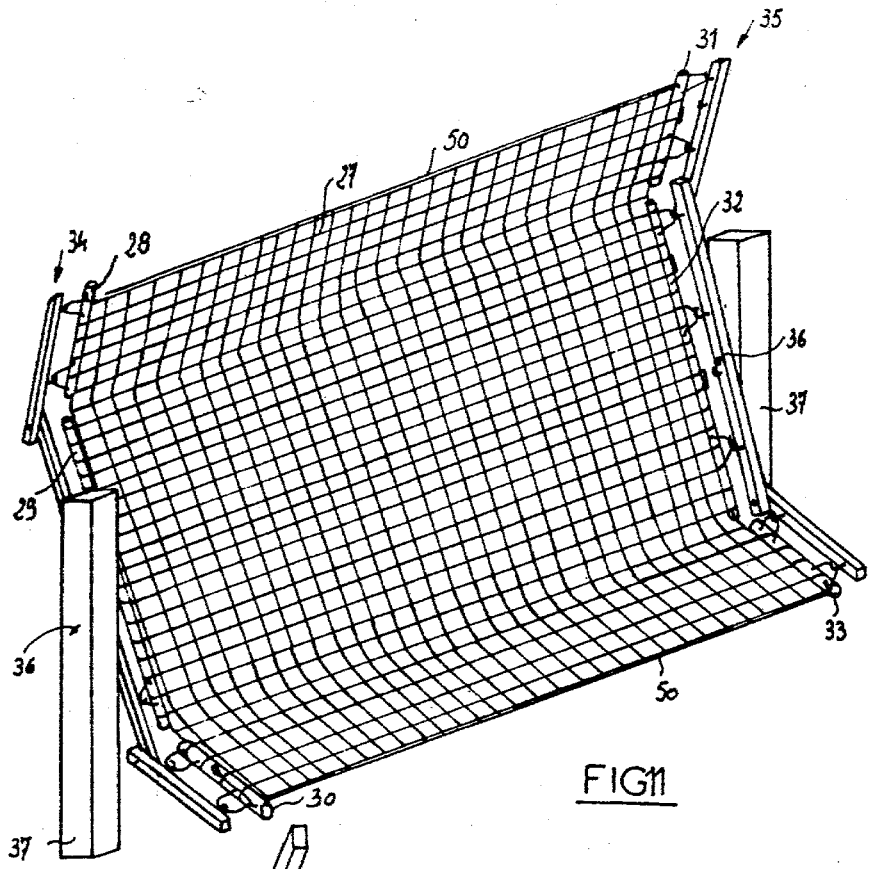
FIG. 11 is a general perspective view of a training device according to another variation of the invention.

FIG. 11 shows a device according to a variation, comprising a net 27 of the inextensible type stretched by means of rigid and rectilinear upright members 28 to 33 between two terminal stiffeners 34 and 35.

Each stiffener comprises a transverse securing pivot 36 intended to be fixed in a removable manner to a fixed structure. The fixed structure may be constituted for example by two stakes 37, but it could also be constituted by two parallel walls or any other fixed member located in the open air or inside a building, provided that the interior dimensions of the building are sufficiently large. The fixed structure may advantageously be constituted by a football or hand ball goal-mouth. The stiffeners are provided such that the axis of each pivot 36 is substantially horizontal and parallel to the net 27. The pivots 36 may be constituted by bolts for example.

Each stiffener comprises three portions 38, 39, 40 (FIG. 12), the intermediate portion 39 supporting the pivot 36 substantially at its centre. The adjacent portions are pivoted to each other by their ends by means of pivots 41 whose axis is substantially parallel to the axis of the pivots 36 and a locking spacer member 42 is mounted between said portions in order to span the pivot 41, thus keeping the portions of stiffener in a fixed position one with respect to the other. Each end of a spacer member thus comprises a point of attachment to a portion of stiffener and the location of this point is adjustable either on the spacer member, or on the stiffeners, or on both, so that it is possible to vary the angle formed by the adjacent portions of stiffener before locking the spacer member.

Figure 13:
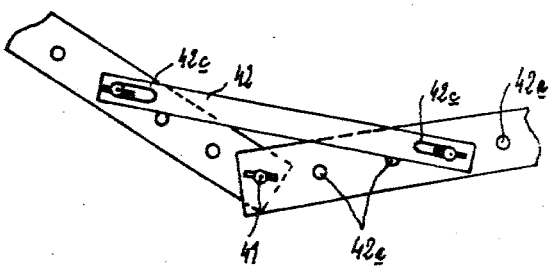
FIG. 13 is a partial side view of this stiffener.

As has been shown in FIG. 13, each pivot 41 may be constituted by a simple bolt passing in succession through holes provided in adjacent portions of stiffener, the latter being mounted by stacking on the bolt. It is possible to use the same technique for producing the points of attachment of the spacer members to the portions of stiffener. In this case, a series of holes 42*a* is provided on the spacer members and/or on the stiffeners, which holes are capable of receiving a locking bolt 42*b*, adjustment being effected by the choice of one of the holes 42*a* in each member. It is also possible to obtain finer adjustment of the relative angular position of the portions of stiffener by providing longitudinally elongated holes 42*c* on the spacer members.

Figure 14:
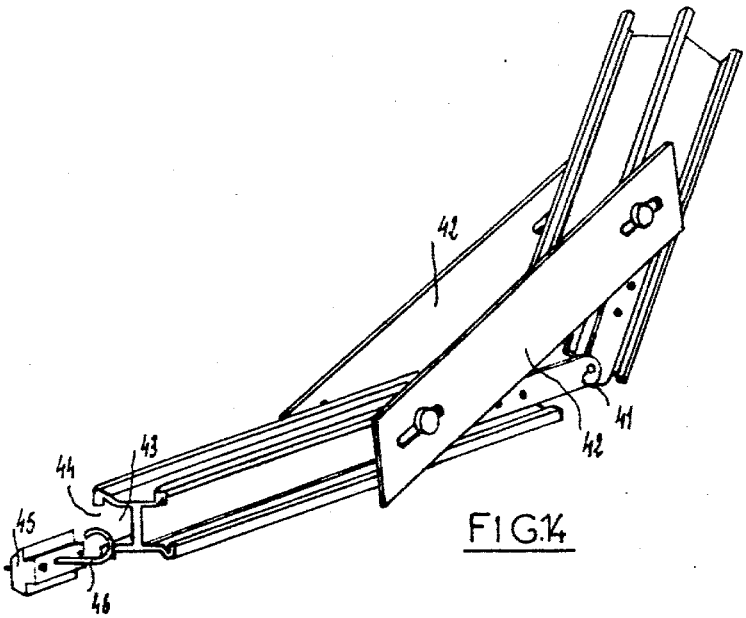
FIG. 14 is a partial perspective view of a stiffener according to a variation of the invention.

According to a variation illustrated in FIG. 14, the portions of stiffener are constituted by portions of sectional member provided with longitudinal recesses 43 and the pivots 41 are constituted by hinges, adjacent portions of stiffener being located one in the extension of the other. Each longitudinal recess 43 opens on the outside by a slot 44 which is less wide than the recess itself. And the latter is able to receive the enlarged heel portion of a block 45 which can be locked at any point along the portion of sectional member. The slots 44 may thus be provided with adjustable blocks comprising securing points for the locking spacer members 42 or supporting hooks 46. The hooks 46 are distributed along the stiffener, adjacent the net 27.

The stiffener constructed according to FIG. 13 also comprises hooks 46, but the latter are stationary, since they are permanently engaged in the holes in the stiffener.

Figure 15:
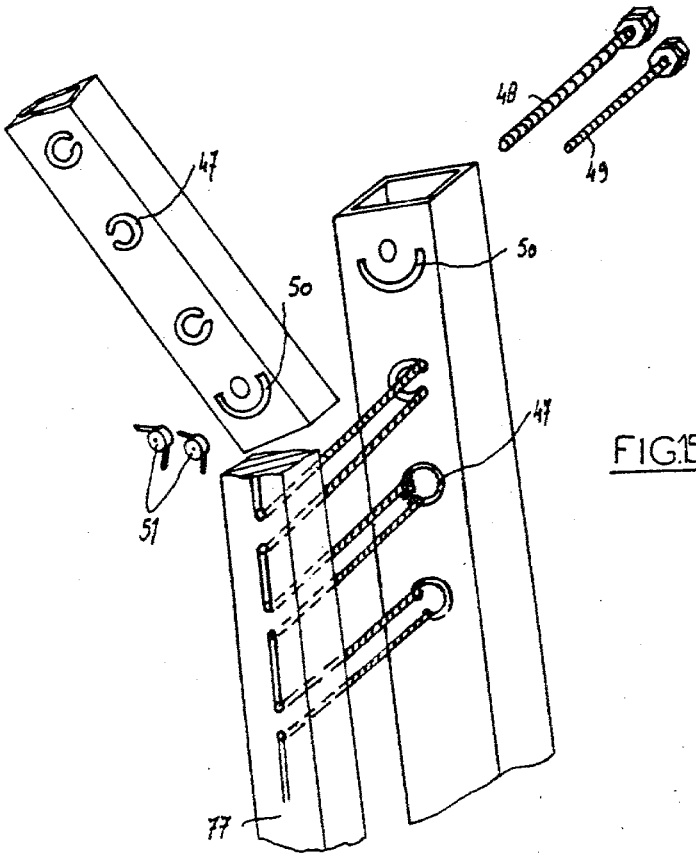
FIG. 15 is a partial exploded perspective view of a stiffener according to a variation of the addition.

According to one variation, FIG. 15 shows a device in which in place of the hooks 46, a stiffener comprises C-shaped recesses 47 through its outer wall. Each portion of stiffener is also pivoted on the adjacent portion or portions by means of a bolt 48 located in the same manner as the pivot 41 in FIG. 13, but each bolt 48 is associated with a bolt 49 which passes through two recesses in the shape of a portion 50 of a circle centered on the axis of the bolt 48 respectively on the two portions of stiffener. In this case, when the angular adjustment of the portions of stiffener has been effected, the bolt 49 is locked in order to prevent the portions of stiffener from rotating about the bolt 48.

All the bolts are preferably provided with locking wing nuts 51 and the same is true for the bolts constituting the pivots 36, in order to obtain rapid manual assembly and dismantling, without tools.

Figure 16:
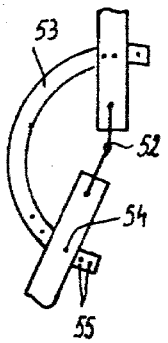
FIG. 16 is a partial side view of a stiffener according to another variation of the invention.

According to another variation illustrated in FIG. 16, the end portions pivoted to each other by means of a hinge 52 can be locked by means of a flat concave clamp 53 integral with one of the two portions of stiffener. The other adjacent portion comprises a transverse hole capable of receiving a cotter pin 54 which is inserted through one of the holes 55 in the clamp 53.

Figure 17:
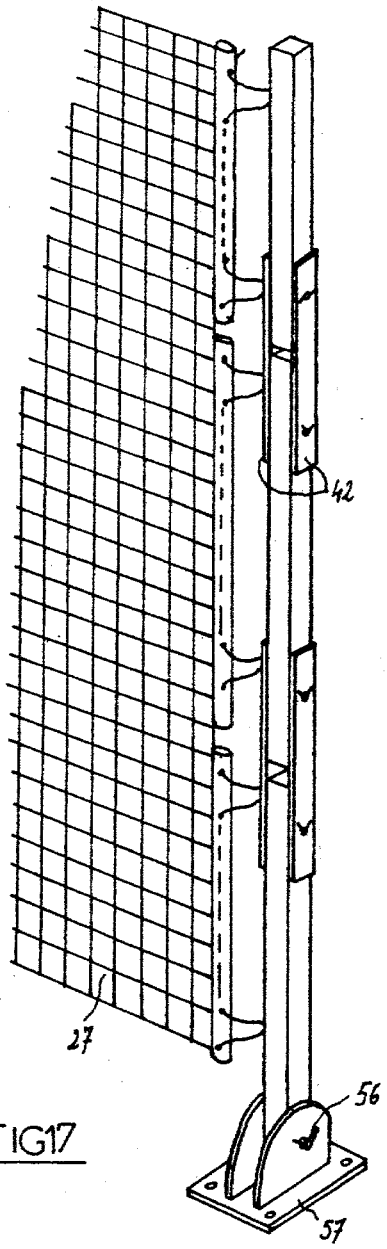
FIGS. 17 and 18 are perspective views of a stiffener according to another variation of the addition.
Figure 18:
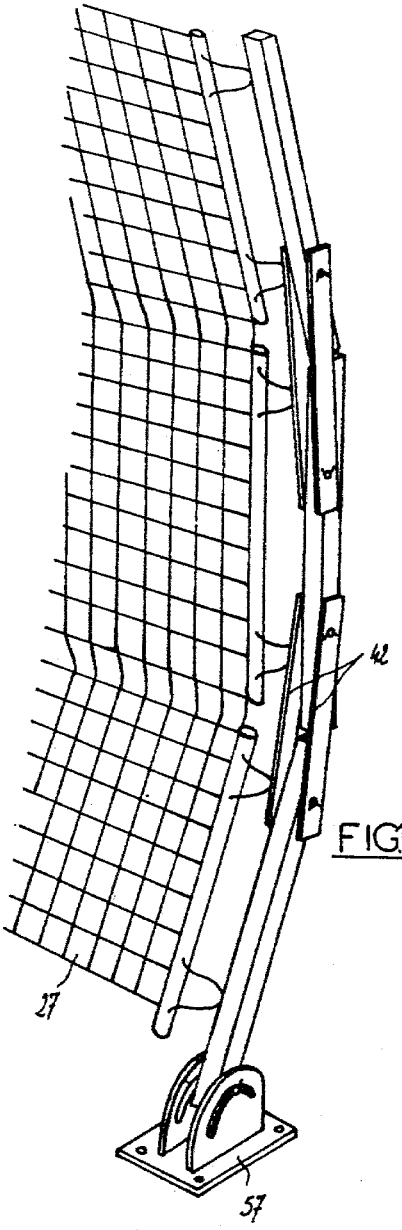
Figure 19:
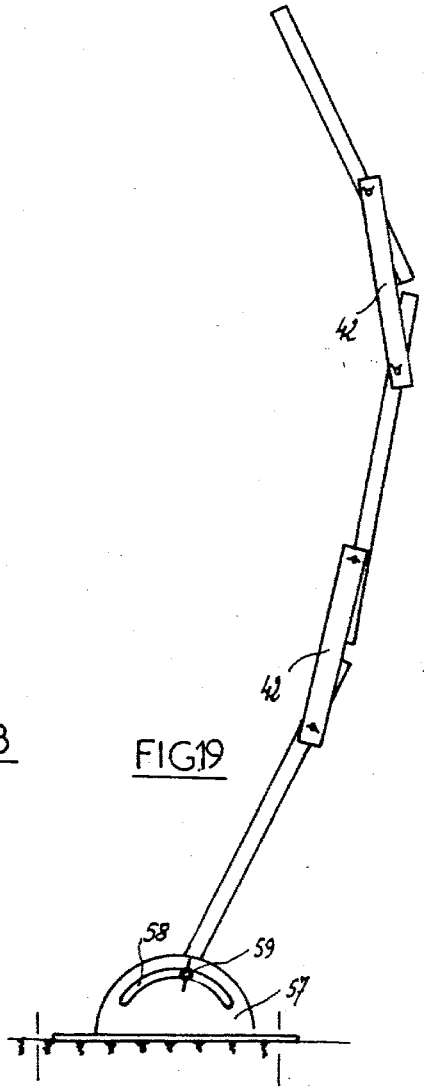
FIGS. 19 and 20 are side views of this stiffener, illustrating the operation.
Figure 21:
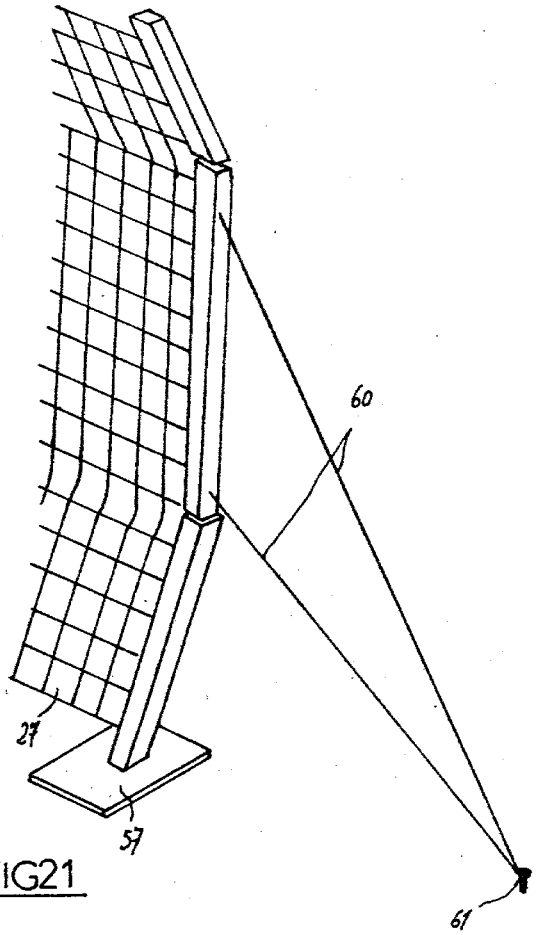
FIGS. 21 and 22 are perspective views of this stiffener, showing other possibilities of use.
Figure 22:
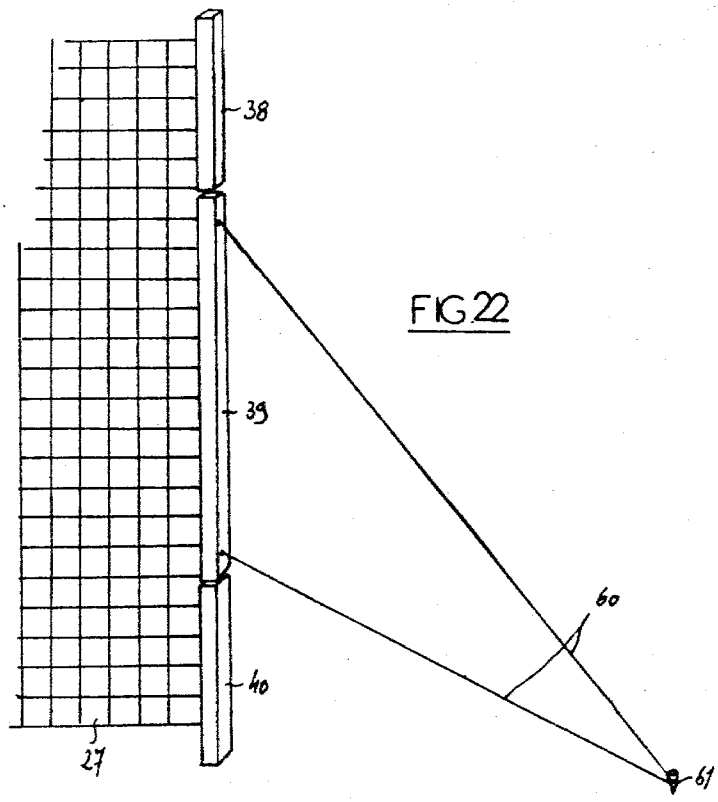

According to another variation illustrated in FIGS. 17 and 18, each pivot of a stiffener is advantageously associated with two spacer members 42 arranged symmetrically on either side of the stiffener. In this case, the pivot 36 of each intermediate portion of stiffener has been replaced by a pivot 56 integral with a clevis 57 fixed to the ground. As shown in FIG. 19, the clevis 57 comprises a semi-circular aperture 58 which receives a bolt 59 integral, like the pivot 56, with the lower portion of stiffener. As has been shown in FIGS. 21 and 22, each stiffener may be associated with several guys 60 stretched between this stiffener and a fixed anchoring point 61.

Figure 23:
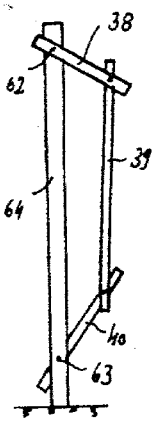
FIGS. 23 to 26 are side views of stiffeners according to other variations.

According to a variation illustrated in FIG. 23, each stiffener may be fixed by means of two pivots 62 and 63, for example to a post 64.

Figure 24:
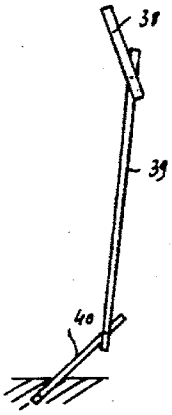

According to another variation illustrated in FIG. 24, the lower portion of a stiffener may be buried in the ground.

Figure 25:
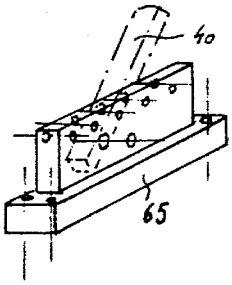
Figure 26:
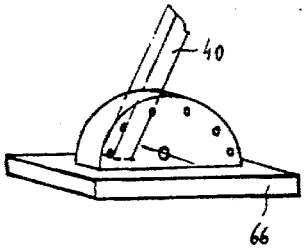

According to variations illustrated in FIGS. 25 and 26, the lower portion of a stiffener may be held on the ground by means of stands 65 and 66 provided with various holes, each hole corresponding to one inclination of the stiffener.

Figure 12:
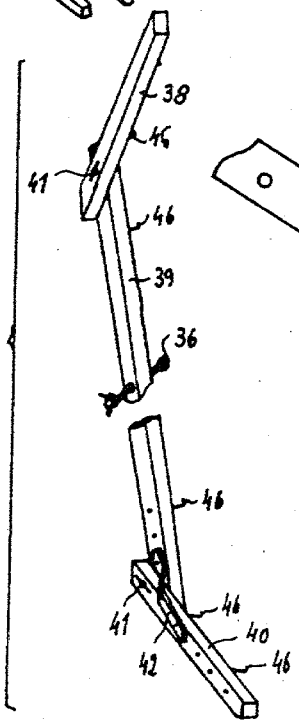
FIG. 12 is a perspective view of one of its stiffeners.
Figure 27:
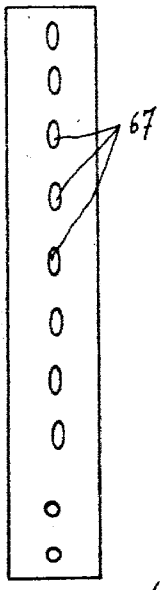
FIG. 27 is a side view of an upright.
Figure 28:
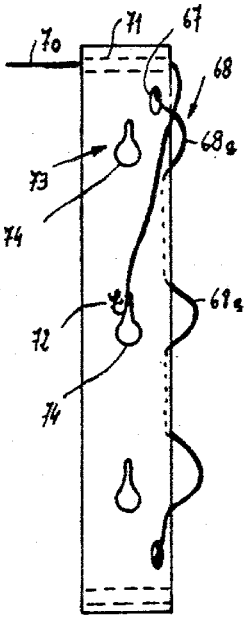
FIG. 28 is a front view of this upright.

As can be seen more particularly in FIGS. 27 and 28, each upright is advantageously constituted by a portion of tube of circular cross section and comprises, adjacent the corresponding stiffener, a series of holes 67 in which a resilient cord 68 passes. The cord 68 thus extends from one end to the other of the upright, passing successively on the inside and outside of the upright in the gaps comprised between the holes 67. The two ends of the cord 68 are knotted and the knots 69 are too large to be able to pass through the holes. These knots may even be too large to be able to pass through the uprights themselves: they thus remain on the outside, whereas the corresponding end of the cord leaves through one axial end of the portion of tube. The cord 68 is sufficiently long so that it is possible to stretch its parts 68*a* located outside the portion of tube and attach each of them to one of the hooks 46 (FIG. 12). In the case of stiffeners provided with C-shaped recesses 47 (FIG. 15), the part 68*a* to be attached is engaged in one of the said recesses 47 and it is placed such that it is astraddle the solid area 47*a* defined between the two ends of the corresponding recess 47.

An inextensible cord 70 is threaded in the top and bottom substantially horizontal edges of the net 27. At each end of the net, each cord 70 passes through a transverse hole 71 (FIGS. 27 and 28) provided in the end of an upright. Beyond the hole 71, the end of the cord 70 comprises a knot 72 which is too large to be able to pass through the hole 71. The corresponding upright comprises a series of longitudinal slots 73. Each slot 73 comprises, at its end furthest from the hole 71, an enlarged portion 74 through which the knot 72 is able to pass. The cord 70 passes freely through the remainder of the slot, but not the knot 72.

Figure 31:
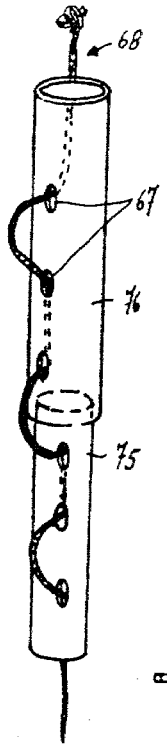
FIG. 31 shows a telescopic upright in perspective view.

As shown in FIG. 31, it is possible to provide telescopic uprights formed by two portions of tube 75 and 76 sliding one in the other. The two portions of tube thus comprise holes 67 for receiving the elastic cord 68. In the area where the two portions of tube overlap, the cord 68 passes simultaneously through these two portions of tube, the holes 67 being aligned. It can be seen that it is the cord 68 itself which ensures locking of the portions of tube with respect to each other.

Figure 32:
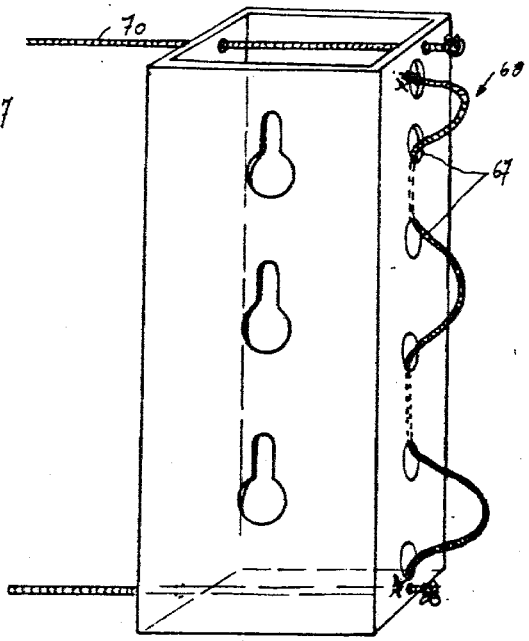
FIG. 32 is a view of an upright according to a variation.

As shown in FIG. 32, each upright may also be constituted by a portion of tube of square cross section, according to the same operating principle, i.e. with the same set of perforations. Each upright may even be constituted by a solid bar 77 (FIG. 15), the latter comprising a series of transverse holes which pass therethrough from one side to the other.

Figure 33:
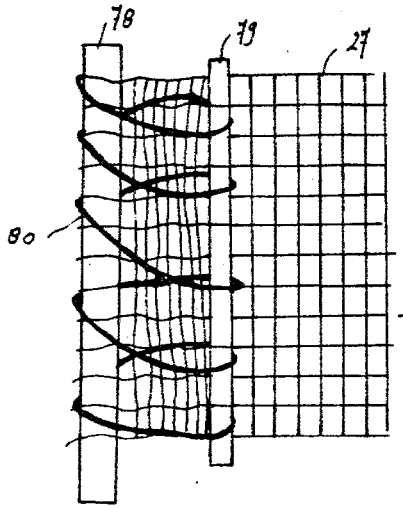
FIG. 33 is a partial front view of a training device provided with a rigid member associated with an upright.
Figure 34:
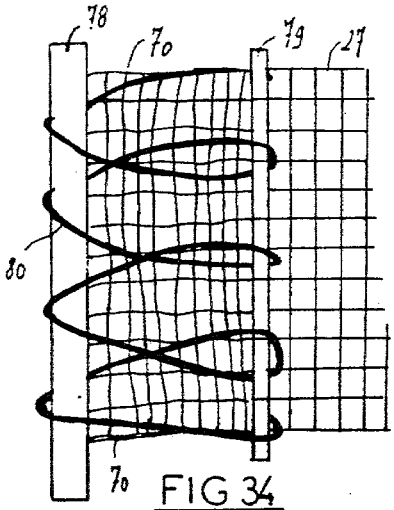
FIG. 34 is a partial front view of the same device, the net being less taut.

According to another variation illustrated in FIGS. 33 and 34, each upright 78 may be associated with a rigid rectilinear member 79 which is threaded through a row of meshes of the net 27. An inextensible cord 80 is simultaneously placed around the upright 78 and the member 79 in order to connect them one to the other whilst trapping a portion of the net which is more or less slack and not used. Depending on the tightness of the cord 80, the member 79 is closer or less close to the upright 78 and the net 27 is more or less taut.

The operation is as follows.

Figure 36:
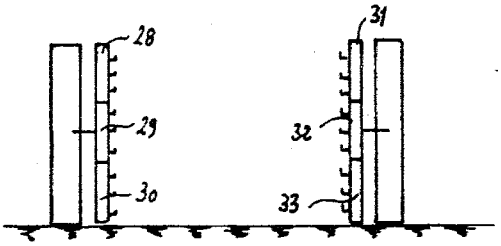
Figure 37:
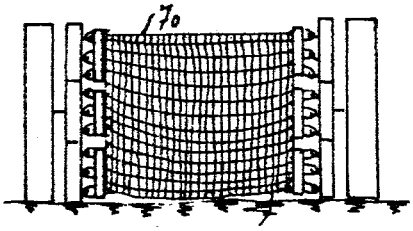
Figure 38:
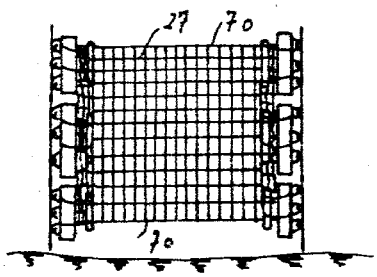

To install the training device, it is sufficient to secure the stiffeners, then to attach the net to the stiffeners (FIGS. 36 and 37).

Figure 29:
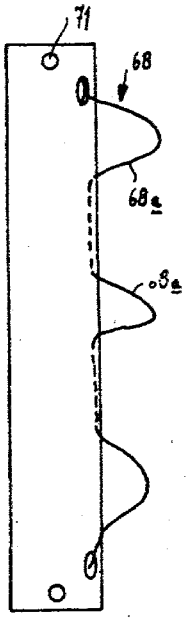
FIGS. 29 and 30 are other front views of the same upright, illustrating the operation.
Figure 35:
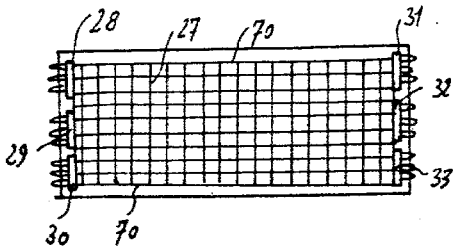
FIGS. 35 to 39 are diagrammatic front views of a training device according to the invention, showing the successive stages of assembling this device in a fixed structure.

The useful length of the net is firstly adjusted by choosing the rows of meshes through which the uprights 28 to 33 are threaded (FIG. 35). The useful height of the net is adjusted in the same manner by choosing the rows of meshes through which the inextensible upper and lower cords 50 are threaded. Finally, the useful length of the inextensible cords 50 is adjusted by locking their ends in appropriate slots 73 (FIG. 28). The latter adjustment is preferably undertaken when the net is already attached to the stiffeners. This attachment takes place by engaging the parts 68*a* of the elestic cords 68 in the hooks 46 (FIG. 12) or in the C-shaped recesses 47 (FIG. 15). When all the parts 68*a* of each upright are thus attached, a highly stretched net is available, which is capable of returning balls with force. It is also possible to attach only certain of the parts 68*a*, for example those located at the ends of each upright (FIG. 29): the net is thus stretched to a lesser extent and returns the balls more gently.

Figure 39:
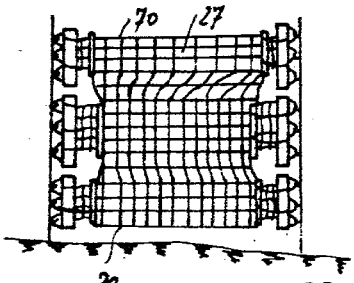

To stretch the net on the spot, once it is mounted between the two stiffeners, it is possible to use members 79 (FIGS. 33 and 34). Thus, FIG. 37 shows a device according to the invention comprising two stretched inextensible cords 50, whereas the net 27 remains slack. The members 79 are thus introduced into the appropriate rows of mesh and the tension of the net is adjusted by tightening the cords 80 to a greater or lesser extent. It will be noted that each portion of the net comprised between two opposed uprights may be adjusted as regards tension independently of the other portions of the net. This is advantageous if one wishes to have portions of the net having different responses (FIG. 39).

Figure 30:
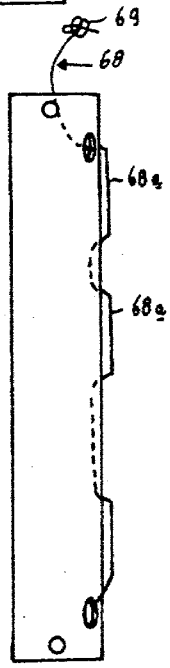

The training device according to the invention comprises the following advantages in particular:

The introduction of an upright into a series of meshes is facilitated by the fact that it is sufficient to previously pull on the ends of the elastic cord 68 to simultaneously place all the parts 68*a* of said cord against the upright (FIG. 30). The excess net is then rolled along the upright and attached thereto as above-described.

Figure 20:
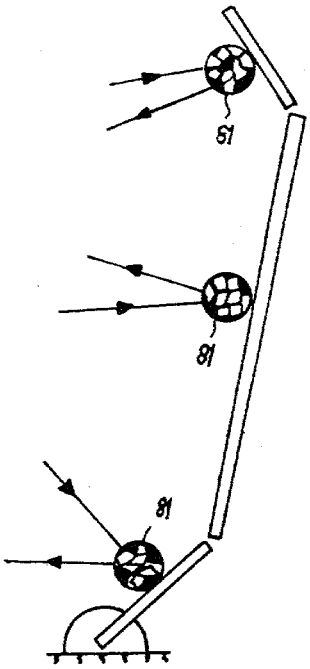
Figure 40:
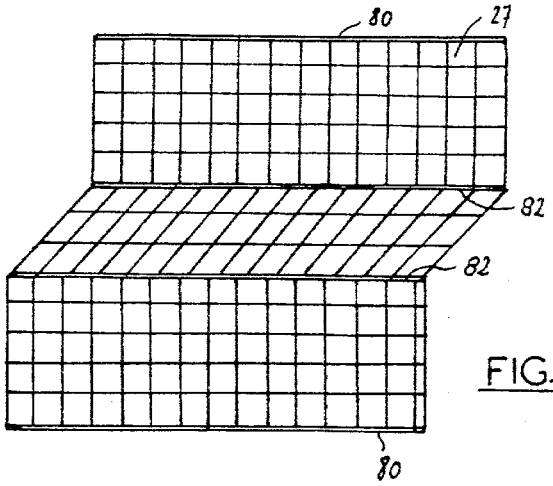
FIG. 40 is a diagrammatic perspective view of a training device according to the invention.

Once mounted, the net can provide three planes inclined in a different manner one with respect to the other (FIG. 40). It is possible to vary these inclinations at will by adjusting the value of the angle formed by each pair of adjacent portions of stiffener, by the means described above. The various inclinations are chosen by the user himself, depending on the training which he wishes to carry out. As an example, FIG. 20 shows some ways in which a ball 81 may bounce on the various portions of the same net.

If the device is always used at the same location, for example in a garden between two stakes, the above-described adjustments need to be made only once: it is possible to store the net without removing the uprights 28 to 33 from their respective rows of meshes and without removing the ends of the inextensible cords 80 from their slots. Assembly and dismantling are very rapid: it is sufficient to assemble and dismantle the two stiffeners which, in most cases, are held solely by two pivots. When not in use, the location is completely free.

Even if the net is slack, it is still possible for the device to operate. In fact, when the ball strikes the net moving it rearwards, it forces the inextensible cords 80 to carry out the same movement. The latter pull on the corresponding uprights 28 to 33 (see FIG. 11), which causes the tension of the elastic cords 68. By resuming their position of equilibrium, the elastic cords 68 return the ball. Therefore, there is not even any need for the net to be stretched.

There are many possibilities of adjusting the dimensions of the useful portion of the net, both as regards height as well as length, these possiblities being further increased by the use of telescopic uprights similar to that of FIG. 31. The upper or lower parts of the net which are not used may remain free or be contained in a casing.

Whatever the number of uprights associated with each stiffener, two inextensible cords 80 are sufficient to ensure satisfactory operation of the training device. However, it is possible to insert other inextensible cords at any point of the net.

It is thus possible to place two intermediate inextensible cords 82 if the net has three different planes (FIG. 40), each cord 82 extending at the junction of two adjacent planes of being connected to the corresponding opposed uprights.

Figure 41:
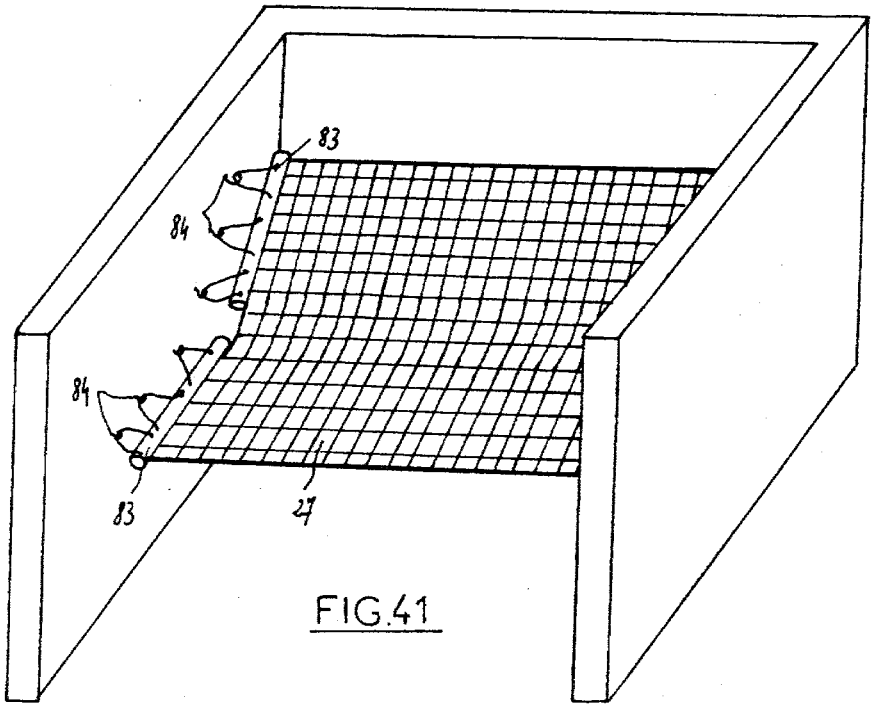
FIG. 41 is a perspective view of a training device according to the invention, installed between two walls.

In certain cases, it is possible to use the training device without using stiffeners. Thus, FIG. 41 shows a device whose uprights 83 are directly connected to hooks 84 sealed in the wall, the connection taking place by means of elastic cords 68.

What is claimed is:

1. A training device for rebounding a game ball comprising:

at least one pair of substantially parallel spaced apart elongated rigid upright members;

an inextensible net stretched between said at least one pair of substantially parallel rigid upright members;

elastic means attached to said at least one pair of substantially parallel rigid upright members and extending outward from said net;

at least one pair of elongated terminal stiffeners, each stiffener being substantially parallel to and spaced from said respective upright member and being attached to said elastic means, said at least one pair of terminal stiffeners further being mounted adjacent said at least one pair of substantially parallel rigid upright members such that said at least one of said pair of substantially parallel rigid upright members, said one pair of terminal stiffeners and said elastic means cooperate to form a stretched out inextensible net structure for rebounding a game ball; and means for pivotally mounting each of said stiffeners to an upright support structure to thereby render said net angularly adjustable relative to a support surface.

2. A training device for ball games, said device to be mounted to a support structure, said device comprising:

an inextensible net having a first end and a second end, said first end having a first row of mesh and said second end having a second row of mesh;

a plurality of unconnected first uprights engaged through said first row of mesh, said first uprights being aligned end to end along said first end of said net;

a plurality of unconnected second uprights engaged through said second row of mesh, said second uprights being aligned end to end along said second end of said net;

first means for stiffening said device, comprising:

a plurality of first rigid stiffeners;

first means pivotally connecting said plurality of first stiffeners in consecutive sequence; and first means for elastically attaching each of said plurality of first stiffeners to a corresponding one of said plurality of first uprights;

second means for stiffening said device, comprising:

a plurality of second rigid stiffeners;

second means for pivotally connecting said plurality of second stiffeners in consecutive sequence; and second means for elastically attaching each of said plurality of second stiffeners to a corresponding one of said plurality of second uprights and;

means for pivotally mounting said device to a support structure.

3. A training device according to claim 2 and further comprising:

first locking means for fixing the position of at least one of said first stiffeners relative to an adjacent one of said first stiffeners, said first locking means comprising a first elongated spacer member adjustably connecting at least one first stiffener to at least one adjacent first stiffener; and second locking means for fixing the position of at least one of said second stiffeners to an adjacent one of said second stiffeners, said second locking means comprising a second elongated spacer member adjustably connecting at least one second stiffener to at least one adjacent second stiffener;

means for locking one end of said first and second spacer members to said at least one first and second stiffeners respectively; and means for locking the other end of said first and second spacer members to said at least one adjacent first and second stiffeners respectively.

4. A training device according to claim 3 wherein said spacer members have elongated holes therethrough and said locking means further comprise locking bolts disposed through said holes, said bolts being slidably disposed in said hole such that a stiffener can be adjustably locked in position relative to an adjacent stiffener.

5. A training device for ball games, said device to be mounted to a support frame, said device comprising:

an inextensible net having a first end and a second end, said first end having a first row of mesh and said second end having a second row of mesh;

a first tubular upright engaged through said first row of mesh, said first upright having a first series of holes disposed thereon;

a second tubular upright engaged through said second row of mesh, said second upright having a second series of holes disposed thereon;

a first elastic cord disposed through said first series of holes into and out of said first upright in sequence so as to expose portions of said first elastic cord outside of said first tubular upright;

a second elastic cord disposed through said second series of holes into and out of said second upright in sequence so as to expose portions of said second elastic cord outside of said second tubular upright;

first stiffening means connected to exposed portions of said first elastic cord; and second stiffening means connected to exposed portions of said second elastic cord, whereby said stiffening means can be connected to said support structure to elastically support said net.

6. A training device for ball games, said device to be mounted to a support frame, said device comprising:

an inextensible net having a first end and a second end, said first end having a first row of mesh and said second end having a second row of mesh;

a first solid upright engaged through said first row of mesh, said first upright having a first series of holes disposed therethrough;

a second solid upright engaged through said second row of mesh, said second upright having a second series of holes disposed therethrough;

a first elastic cord passing sequentially through said first series of holes so as to pass through said first upright first in one direction and then in the opposite direction thereby exposing portions of said first cord between adjacent holes;

a second elastic cord passing sequentially through said second series of holes so as to pass through said second upright first in one direction and then in the opposite direction thereby exposing portions of said second cord between adjacent holes;

first stiffening means connected to exposed portions of said first elastic cord; and second stiffening means connected to exposed portions of said second elastic cord, whereby said stiffening means can be connected to said support structure to elastically support said net.

7. A training device according to claim 5 wherein said elastic cords having stop means for fixing the position of the ends of the cords such that the exposed portions are stretched to connect to said stiffening means.

* * * * *

UNITED STATES PATENT OFFICE

CERTIFICATE OF CORRECTION

Patent No. 4,239,235 Dated December 16, 1980

Inventor(s) Remy G. Torres

It is certified that error appears in the above-identified patent and that said Letters Patent are hereby corrected as shown below:

Column 2, line 38, before the word "of" first occurrence, insert ----the----.

Column 2, line 43, before the word "stiffener" insert ----the----.

Column 3, line 54, delete the word "group" and insert ----ground----.

Column 5, line 27, delete the word "ground" and insert ----field----.

Column 5, line 57, delete the word "boot" and insert ----trunk----.

Column 5, line 68, delete the word "ground" and insert ----field----.

Column 6, line 57, delete the word "orientate" and insert ----orient----.

Column 7, line 23, delete the word "centre" and insert ----center----.

Column 9, line 37, delete the word "whilst" and insert ----while----.

Column 9, line 45, delete the word "firstly" and insert ----first----.

UNITED STATES PATENT OFFICE

CERTIFICATE OF CORRECTION

Patent No. 4,239,235 Dated December 16, 1980

Inventor(s) Remy G. Torres

It is certified that error appears in the above-identified patent and that said Letters Patent are hereby corrected as shown below:

Column 10, line 36, after the word "free" insert ----of the device----.

Column 10, line 47, after the word "regards" insert ----to----.

Column 10, line 48, after the word "as" second occurrence insert ----to----.

Column 10, line 50, after the word "of" first occurrence insert ----in----.

Column 10, line 61, after the word "of" insert ----the net and----.

Column 11, line 64, after the word "stiffeners" insert ----relative----.

Signed and Sealed this

Eighth Day of September 1981

[SEAL]

Attest:

GERALD J. MOSSINGHOFF

Attesting Officer

Commissioner of Patents and Trademarks